US007762658B2

(12) United States Patent
Iwase

(10) Patent No.: US 7,762,658 B2
(45) Date of Patent: Jul. 27, 2010

(54) INK JET PRINTER

(75) Inventor: Fumiyoshi Iwase, Hamamatsu (JP)

(73) Assignee: Roland DG Corporation, Hamamatsu-shi (JP)

( * ) Notice: Subject to any disclaimer, the term of this patent is extended or adjusted under 35 U.S.C. 154(b) by 292 days.

(21) Appl. No.: 11/743,342

(22) Filed: May 2, 2007

(65) Prior Publication Data

US 2009/0021569 A1 Jan. 22, 2009

Related U.S. Application Data

(62) Division of application No. 10/809,892, filed on Mar. 25, 2004, now Pat. No. 7,232,212.

(30) Foreign Application Priority Data

Nov. 11, 2003 (JP) ..... 2003-381058

(51) Int. Cl.
*B41J 2/01* (2006.01)

(52) U.S. Cl. ..... 347/102; 347/101

(58) Field of Classification Search ..... 347/102, 347/101; 101/488; 219/216; 346/25
See application file for complete search history.

(56) References Cited

U.S. PATENT DOCUMENTS

| | | | | |
|---|---|---|---|---|
| 4,739,415 | A * | 4/1988 | Toyono et al. | 358/296 |
| 6,145,979 | A * | 11/2000 | Caiger et al. | 347/102 |
| 6,163,036 | A * | 12/2000 | Taninaka et al. | 257/88 |
| 6,457,823 | B1 * | 10/2002 | Cleary et al. | 347/102 |
| 6,525,752 | B2 * | 2/2003 | Vackier et al. | 347/130 |
| 6,536,889 | B1 | 3/2003 | Biegelsen et al. | |
| 6,561,640 | B1 | 5/2003 | Young | |
| 6,783,227 | B2 | 8/2004 | Suzuki et al. | |
| 7,249,836 | B2 * | 7/2007 | Yokoyama | 347/102 |
| 7,488,065 | B2 * | 2/2009 | Yokoyama | 347/102 |
| 2002/0034594 | A1 * | 3/2002 | Shiveley | 427/558 |
| 2002/0140794 | A1 | 10/2002 | Asano et al. | |
| 2003/0035037 | A1 | 2/2003 | Mills et al. | |
| 2003/0164870 | A1 | 9/2003 | Yamamoto | |
| 2003/0184631 | A1 | 10/2003 | Suzuki et al. | |
| 2004/0036753 | A1 | 2/2004 | Hirai | |
| 2004/0164325 | A1 * | 8/2004 | Siegel | 257/200 |
| 2006/0121208 | A1 * | 6/2006 | Siegel | 427/487 |

FOREIGN PATENT DOCUMENTS

| | | | |
|---|---|---|---|
| JP | 10190058 | A | 7/1998 |
| JP | 15 2003-145725 | | 5/2003 |
| JP | 2003145741 | A | 5/2003 |
| JP | 2003-191594 | A | 7/2003 |
| JP | 2003191507 | A | 7/2003 |
| JP | 2003191593 | A | 7/2003 |

* cited by examiner

*Primary Examiner*—Stephen D Meier
*Assistant Examiner*—Leonard S Liang
(74) *Attorney, Agent, or Firm*—Ditthavong Mori & Steiner, P.C.

(57) ABSTRACT

An ink jet head of an ink jet printer comprises an ink jet nozzle ejecting ultraviolet curing ink, a pair of ultraviolet LEDs provided on both sides of the ink jet nozzle in the moving direction for emitting ultraviolet light in order to cure the ultraviolet curing ink.

14 Claims, 5 Drawing Sheets

FIG. 6A
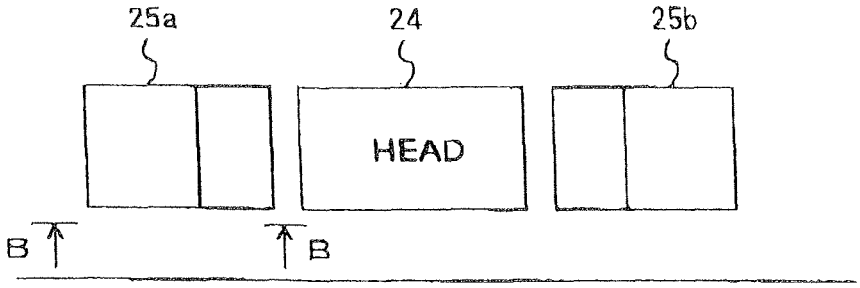
FIG. 6B
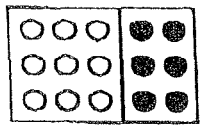
FIG. 7A
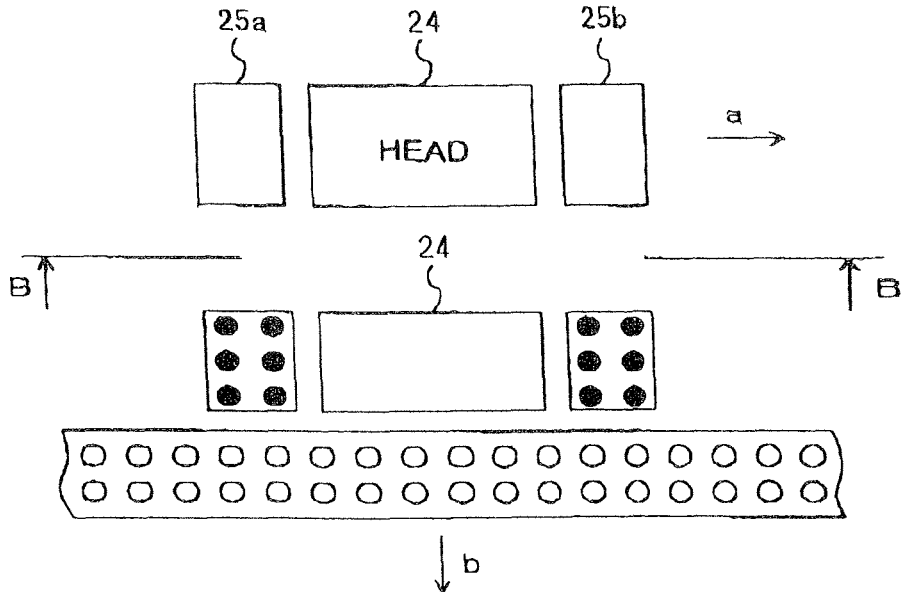
FIG. 7B

INK JET PRINTER

RELATED APPLICATIONS

The present application is a divisional application of U.S. patent application Ser. No. 10/809,892 filed on Mar. 25, 2004 now U.S. Pat. No. 7,232,212, the contents of which are hereby incorporated by reference. The present application is also related to co-pending U.S. application Ser. No. 11/743,244 filed May 2, 2007.

BACKGROUND OF THE INVENTION

1. Field of the Invention

The present invention relates to an ink jet printer using ultraviolet curing ink and more particularly, it relates to an ink jet printer using ultraviolet curing ink, which has a long life.

2. Description of the Background Art

The conventional ink jet printer is disclosed in the following patent document 1, for example. FIG. 8 is a view showing an essential part of the conventional ink jet printer using ultraviolet curing ink.

According to the ink jet printer using the ultraviolet curing ink, the ultraviolet curing ink is applied onto a recording medium such as a recording sheet, and the ultraviolet curing ink is cured and fixed on the recording medium by irradiation of ultraviolet (UV) to form an image.

Referring to FIG. 8, a conventional ink jet printer 101 using the ultraviolet curing ink, comprises ink nozzles 103 mounted on an ink jet head 102, scanning a recording sheet (recording medium) P in accordance with the movement of the ink jet head 102 and jetting out ultraviolet curing ink (referred to as ink also hereinafter) on the recording sheet P, a ultraviolet lamp 104 emitting ultraviolet light to cure and fix the ultraviolet curing ink emitted from the ink nozzle 103 and applied to the recording sheet P, an ink tank (not shown) containing ink before supplied to the ink nozzle 103, a guide rail 106 guiding the ink jet head 102 along the longitudinal direction (along the direction shown by arrow A or B) when the ink jet head 102 is moved, conveying device (not shown) for conveying the recording sheet P at the time of recording, a maintenance unit 110 performing maintenance for the ink nozzle 103, a home position (not shown) in which the ink jet head 102 is in a standby state, a controller (not shown) controlling each component and the like.

In this example, the ink jet head 102 comprises four ink nozzles each for each color used in printing, two ultraviolet lamps 104 (provided on both sides of the ink jet head 102 in the scanning direction) and the like. Each ink nozzle 103 comprises an outlet (not shown) from which the ultraviolet curing ink corresponding to each color is jetted out, at a lower face, for example. In addition, the ultraviolet lamp 104 emits ultraviolet light in the downward direction also, for example.

The maintenance unit 110 comprises a suction cap 171 covering the lower surface of the ink nozzles 103 and sucking ink from the outlet in a sealed state, a drip cap 172 dripping the ink ejected by air ejection of the ink from the outlet to a waste ink tank 175 positioned at lower part of the maintenance unit 110, after the ink was sucked by the suction cap 171, and a blade 173 cleaning off the ink remaining at the outlet of the ink jet head 102 after the air ejection was performed on the drip cap 172. The suction caps 171 are arranged so as to be able to suck the plural number of ink nozzles 103 simultaneously at the time of maintenance. In addition, the maintenance unit 110 comprises a suction pump 174 for sucking the ink nozzle 103. The ink sucked from the outlet by the suction pump 174 is also dripped into the waste ink tank 175.

The maintenance unit 110, the suction cap 171, the drip cap 172 and the blade 173 are made of rubber.

[Patent Document 1] Japanese Unexamined Patent Publication No. 2003-145725 (Paragraph Numbers [0007], [0008] and [0011], FIG. 1)

According to the conventional ink jet printer using the ultraviolet curing ink, since an ultraviolet emission lamp for emitting ultraviolet light is used, the lamp cannot be easily turned off and the lamp has to be kept on while used in general. Therefore, there is a problem that power consumption is large.

In addition, there is a problem that it takes time to light the ultraviolet lamp at the time of start, so that it takes time until the printing starts.

Furthermore, since the ink nozzle is capped at the maintenance unit 110 while the ultraviolet lamp is on, the capping rubber deteriorates by the ultraviolet light and heat and its life becomes short.

Still further, even when the lamp is turned off at the maintenance portion, there is a problem that the capping rubber deteriorates, the sheet medium gets burned, warps or expands by the heat of the lamp.

SUMMARY OF THE INVENTION

The present invention was made in order to solve the above problems and it is an object of the present invention to provide an ink jet printer using ultraviolet curing ink, which contributes to energy saving, is quick to start and has a long life.

An ink jet printer forming an image using ultraviolet curing ink according to the present invention comprises an ink jet head jetting out the ultraviolet curing ink onto a predetermined sheet, moving means for moving the ink jet head relatively to the sheet and an LED provided in the moving direction of the ink jet head and emitting ultraviolet ray.

According to the present invention, the light source for irradiating the ultraviolet curing ink is the LED which emits ultraviolet ray. Since the LED is used, the power consumption is not so large as in conventional example and since the heat is not generated, the rubber does not deteriorate nor the medium is not adversely affected by the heat.

Still further, since the LED has a short wavelength, it does not contain light which has a long wavelength and becomes an unnecessary heat source, so that the printing medium is not adversely affected and measurement to radiate the heat of the ink jet printer and the like is not necessary.

As a result, there can be provided the ink jet printer which can contribute to the energy saving, be quick to start and have a long life. In addition, since the lamp is not used, it becomes compact in size.

Preferably, the LED is provided also in the direction opposite to the moving direction of the ink jet head.

Still preferably, the LED comprises a plurality of LED elements arranged in rows and columns, and the plural LED elements comprise first-wavelength LED elements emitting first-wavelength ultraviolet light, and second-wavelength LED elements emitting ultraviolet light whose wavelength is longer than the first wavelength.

Still preferably, the LED comprises a plurality of first-wavelength LED elements and second-wavelength LED elements, and the plural first-wavelength LED elements and second-wavelength LED elements are arranged alternately in the moving direction.

Still preferably, the plural first-wavelength LED elements of the plural first-wavelength LED elements are arranged closer to the side of the ink jet head than second-wavelength LED elements in its moving direction.

Still preferably, the moving device moves the ink jet head in the main scanning direction which is a feeding direction of the sheet, and in the secondary scanning direction which intersects with the feeding direction of the sheet at right angles, and the plural first-wavelength LED elements are arranged in the secondary direction of the ink jet head and the plural second-wavelength LED elements are arranged on the main scanning side of the ink jet head.

BRIEF DESCRIPTION OF THE DRAWINGS

FIGS. 6A and 6B are views showing an exemplary arrangement of ultraviolet irradiation LED elements;

FIGS. 7A and 7B are views showing an exemplary arrangement of ultraviolet irradiation LED elements.

DESCRIPTION OF THE EMBODIMENTS

One embodiment of the present invention is described with reference to the drawings hereinafter.

Figure 1:
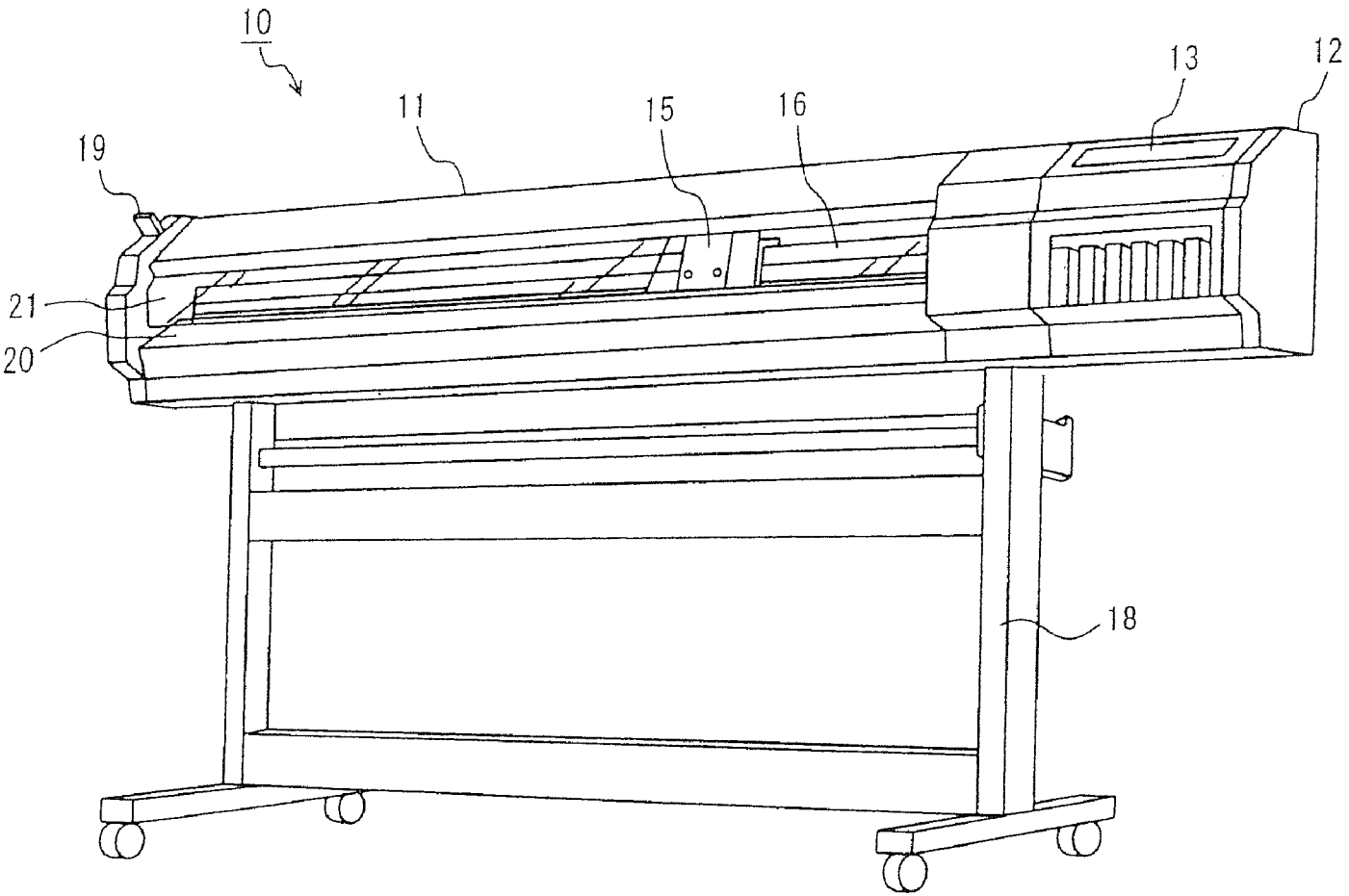
FIG. 1 is a view showing an outline of an ink jet printer according to one embodiment of the present invention.

FIG. 1 is a schematic view showing a whole constitution of an ink jet printer using ultraviolet curing ink according to this embodiment of the present invention.

Referring to FIG. 1, an ink jet printer 10 comprises a body 11 and legs 18 supporting the body 11. The body 11 comprises an ink jet head 15 ejecting the ultraviolet curing ink, a guide rail 16 serving as a guide when the ink jet head 15 is moved in the secondary scanning direction, that is, the longitudinal direction in FIG. 1, an operation panel 13 provided at one end of the body 11 and a side cover 12 provided at both ends of the body 11.

A front cover 21 is provided at the front of the body 11 and a platen 20 is provided at a lower part of the ink jet head 15. A pinch roll lever 19 for pinching a sheet (not shown) with a pinch roll (not shown) on the platen 20 at the time of printing by the ink jet head 15 is provided at the left end of the body 11.

Figure 2:
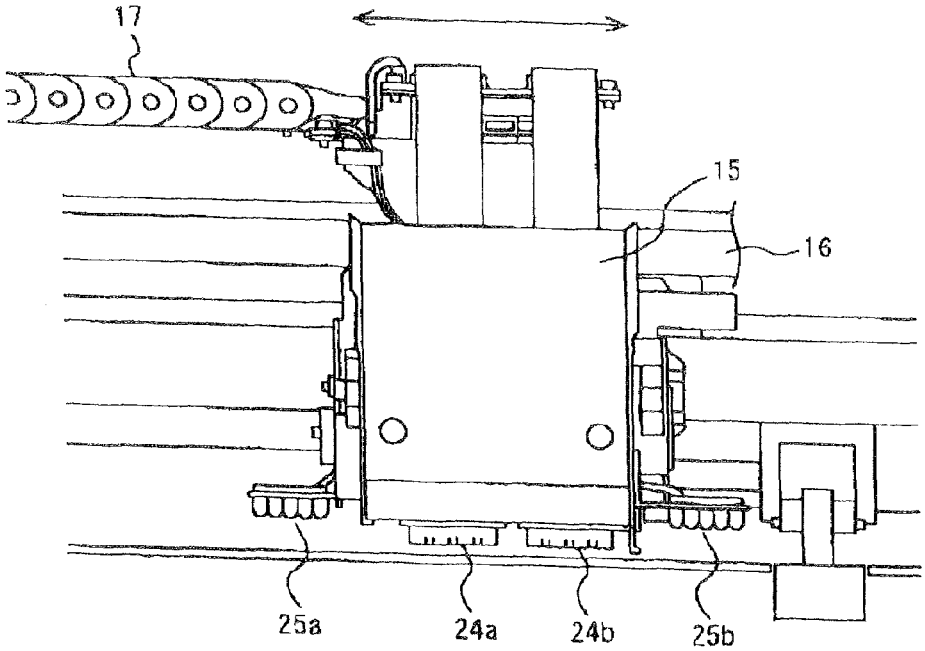
FIG. 2 is a view showing a state in which the ink jet printer is performing printing.

Then, the ink jet head 15 is described. FIG. 2 is a front view showing an essential part of the ink jet head 15. Referring to FIG. 2, the ink jet head 15 is driven by a motor (not shown) through a driving chain 17 along the guide rail 16 in the secondary scanning direction (longitudinal direction shown by an arrow in FIG. 2). Meanwhile, the sheet to be printed is conveyed while pushed by a pinch roller (not shown) in the scanning direction (the direction toward a sheet) which crosses the secondary scanning direction at right angles.

The ink jet head 15 has ink jet nozzles 24 ejecting the ultraviolet curing ink, and ultraviolet irradiation LEDs 25*a* and 25*b* provided on the moving direction side of the ink jet head 15 with respect to the ink jet nozzle 24. The ink jet nozzles 24 comprises an ink jet nozzle 24*a* outputting black ink and an ink jet nozzle 24*b* outputting color ink. FIG. 2 shows a state in which the ink jet head 15 is performing printing.

Then, a capping unit 30 protecting the ink jet head 15 is described. The capping unit 30 is provided on one end, on the side of the operation panel 13, for example of the body 11 of the ink jet printer 10.

Figure 3:
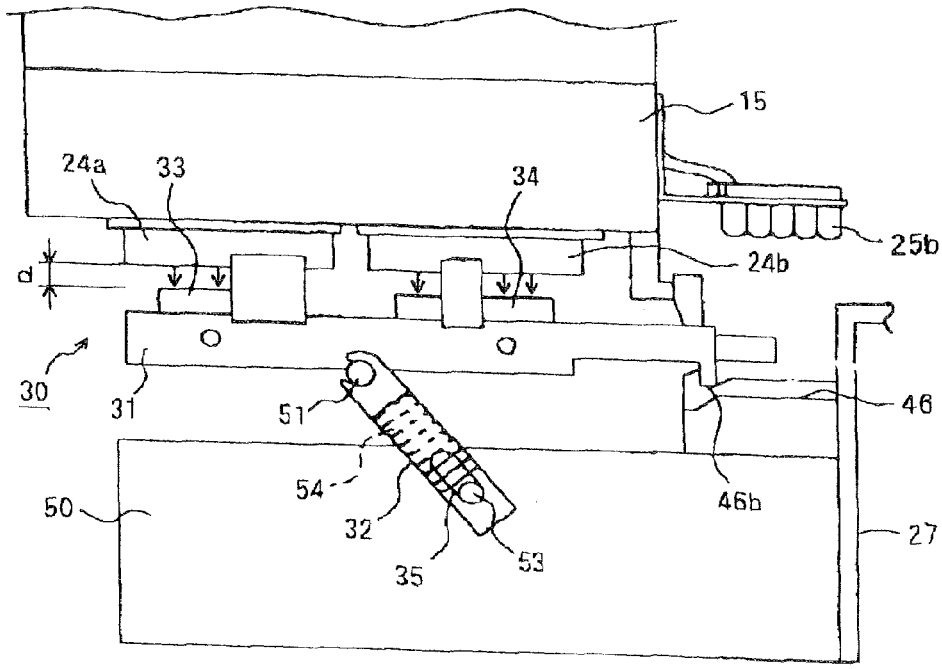
FIG. 3 is a view showing a state in which a nozzle is separated from a capping unit at a capping position.

FIG. 3 is a view showing a detail of the capping unit 30 and a state in which the ink jet nozzle is separated from the capping unit 30. Referring to FIG. 3, the capping unit 30 comprises a board 50 provided in contact with a side end 27 of the operation panel 13 of the body 11, a shaft 53 provided in the board 50, a lever 32 swingably connected to the shaft 53 through an elongate hole 35, and a slider 31 connected to the lever 32 through a shaft 51 and constituted so as to receive the ink jet nozzle 24 when the ink jet head 15 is moved toward the capping unit 30.

Figure 4:
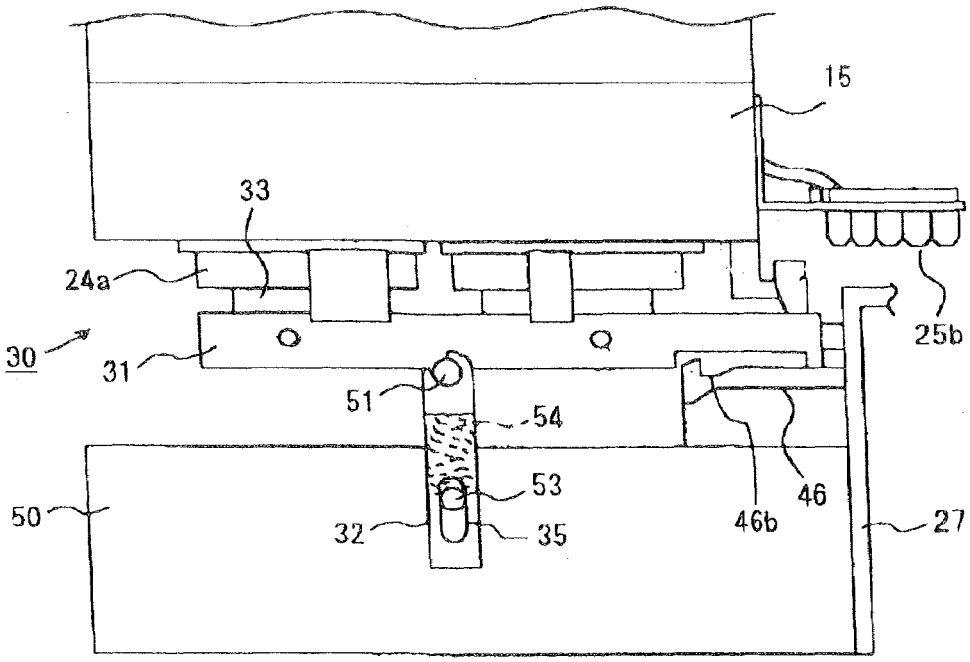
FIG. 4 is a view showing a state in which the nozzle is covered by the capping unit at the capping position.

The capping unit 30 is constituted such that when the ink jet head 15 is moved toward the capping unit 30 provided at the end of the body 11, the slider 31 lifts up by movement of the slider 31 and rotation of the lever 32, and capping members 33 and 34 provided on the slider 31 are attached to the ink jet nozzles 24*a* and 24*b* of the ink jet head 15 (FIG. 4).

The slider 31 is mounted on an upper end of a coil spring 54 having a lower end fixed to the board 50 and slanting to the side of a printing region and set in a buckled state on the side of a non-printing region (on the side of the end 27).

Thus, in the non-capping state, as shown in FIG. 3, the slider 31 having one end regulated by a lowermost end of a slanting surface 46*b* of a guiding member 46 and a middle part regulated by the lever 32 is forced toward the printing region side by the coil spring 54, so that it can maintain a position in which a distance "d" which is suitable for air ejection can be formed 15 without bringing the capping members 33 and 34 into contact with the nozzles 24*a* and 24*b*.

Then, a description is made of a specific arrangement state of the LED elements in the ultraviolet irradiation LED. Basically, since energy allocation at a short wavelength and a long wavelength required for curing the ink depends on the ultraviolet curing ink to be used, it is preferable that the allocation and an amount of the LED elements is set depending on the ink to be used. More specifically, in a case of the ultraviolet ink, a surface of the ultraviolet curing ink is cured at a short wavelength of 250 to 300 nm, and the inside is cured and fixed to a medium at a long wavelength of 300 nm to 370 nm while a dot configuration is maintained. Therefore, an irradiation condition suitable for the ink can be formed by arranging the LED elements to be suitable for the curing reaction wavelength of the ink. Its example is described hereinafter.

Figure 5A:
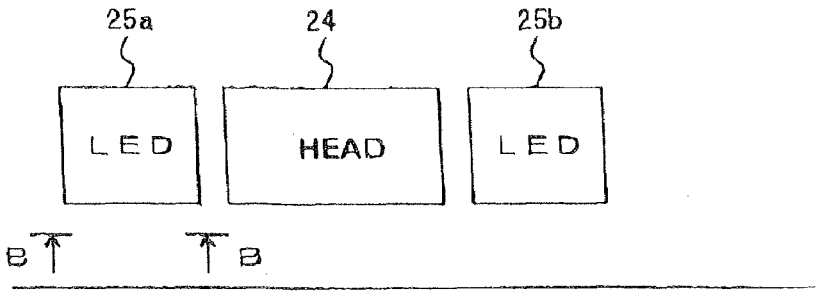
FIGS. 5A and 5B are views showing an exemplary arrangement of ultraviolet irradiation LED elements.
Figure 5B:
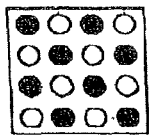
Figure 8:
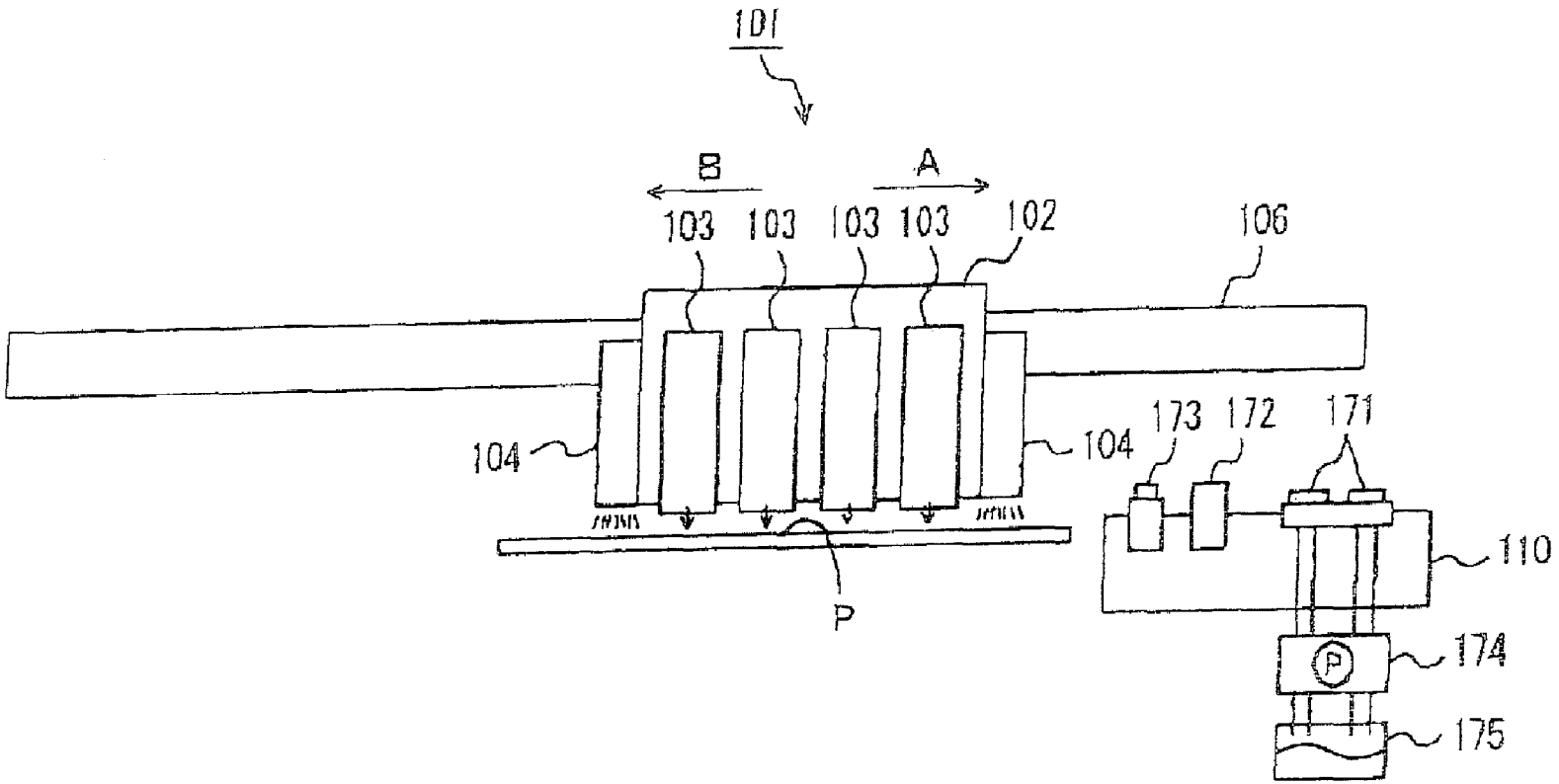
FIG. 8 PRIOR ART
FIG. 8 is a view showing an essential part of the conventional ink jet printer.

FIGS. 5A and 5B are schematic views showing the ink jet head 15 shown in FIG. 2 and ultraviolet irradiation LEDs arranged on both sides thereof. FIG. 5A is a front view seen from the same direction as in FIG. 2 and FIG. 5B is a fragmentary view taken in the direction of arrows B in FIG. 5A. In the drawing, ● designates a short-wavelength LED element and ○ designates a long-wavelength LED element. Referring to FIGS. 5A and 5B, according to this embodiment, the long-wavelength LED elements and the short-wavelength LED elements are mutually and alternately arranged in the shape of a matrix. This arrangement can be suitable for any ultraviolet curing ink.

FIGS. 6A and 6B are views showing another arrangement of the ultraviolet irradiation LED elements. FIG. 6A corresponds to FIG. 5A and FIG. 6B is a fragmentary view taken in the direction of arrows B in FIG. 6A. In FIGS. 6A and 6B also, ● designates the short-wavelength LED element and ○ designates the long-wavelength LED element. In this case, the short-wavelength LED elements are arranged on the side close to the ink jet head and the long-wavelength LED elements are arranged on the side apart from the ink jet head.

As described above, since the short-wavelength ultraviolet is for the purpose of curing the surface of the dot and maintaining a dot configuration, they are arranged close to the ink jet head 15 so as to be able to irradiate the ink immediately after outputted.

FIGS. 7A and 7B are views showing another arrangement of the ultraviolet irradiation LED elements. Referring to FIGS. 7A and 7B, the short-wavelength LED elements are arranged on both sides of a ink jet head 24 in the secondary scanning direction and the long-wavelength LED elements are arranged in the main scanning direction. Although FIG. 7A corresponds to FIG. 5A, the long-wavelength LED elements are omitted and FIG. 7B is a fragmentary view taken in the direction of arrows B in FIG. 7A. In FIGS. 7A and 7B also, ● designates the short-wavelength LED element and ○ designates the long-wavelength LED element. In this case, the short-wavelength LED elements are arranged in the secondary scanning direction (direction shown by "a" in the drawing) which is the moving direction of the ink jet head 15 so as to emit the short-wavelength ultraviolet immediately after the printing by the ink jet head 15, and the long-wavelength ultraviolet is emitted after the ink jet head was moved in the main scanning direction (direction shown by "b" in the drawing).

In the above embodiment, as the wavelength of the LED element which cures the ultraviolet curing ink, the example using two kinds of long wavelength and short length was described. However, there are some ink whose reaction wavelength is one wavelength or three wavelengths and more. Therefore, other than the two kinds of long and short wavelengths, it is preferable that the LED element which outputs the wavelength suitable for the ink is selected and arranged depending on the required allocation.

Although the description was made of the example in which the LEDs are arranged on both sides of the ink jet head because the description was made of the two-way printing in the above embodiment, the present invention is not limited to this and in a case of single-direction printing, there is provided one lamp on one side of the head. Although the two-way printing can be performed with one lamp, since a printing texture of each pass changes depending on the printing direction, it is preferable that the lamp is provided on each side of the head.

Although the ink jet printer was described in the above embodiment, the present invention is not limited to this and may be applied to an ink jet printer having a function of a cutter.

Although the present invention was described with reference to the drawings above, the present invention is not limited to the illustrated embodiments only. Various modifications and variations can be added in the same or an equivalent range of the present invention.

What is claimed is:

1. An apparatus comprising:

a printer head configured to move along a main scanning direction and a secondary scanning direction;

a first group of light emitting diode (LED) elements arranged in adjacent columns and rows and abutting one side of the printer head;

a second group of LED elements arranged in adjacent columns and rows and abutting another side of the printer head, wherein the first group and the second group are arranged along the secondary scanning direction; and a third group of LED elements disposed near the printer head and arranged along the main scanning direction.

2. The apparatus according to claim 1, wherein each of the LED elements in the first group and the second group is configured to emit light at a first wavelength, and the LED elements of the third group is configured to emit light at a second wavelength, the first wavelength being different from the second wavelength.

3. The apparatus according to claim 1, wherein the first wavelength is shorter than the second wavelength.

4. The apparatus according to claim 1, wherein the third group of LED elements are arranged in adjacent columns and rows.

5. An ink jet printer forming an image using ultraviolet curing ink, comprising:

an ink jet head configured to eject out the ultraviolet curing ink onto a predetermined sheet;

moving means for moving said ink jet head relatively to said sheet; and a plurality of light emitting diode (LED) elements arranged in adjacent columns and rows, the LED elements including a plurality of first-wavelength LED elements and a plurality of second-wavelength LED elements, wherein said first-wavelength LED elements being arranged in a first column, wherein said second-wavelength LED elements being arranged in a second column adjacent to said first column, and wherein said first-wavelength LED elements are arranged in a first plurality of adjacent columns that includes said first column, and wherein said second-wavelength LED elements are arranged in a second plurality of adjacent columns that includes said second column.

6. The ink jet printer according to claim 5, wherein said first-wavelength LED elements arranged in said first plurality of adjacent columns are provided adjacent to a first side of said ink jet head, and wherein said second-wavelength LED elements arranged in said second plurality of adjacent columns are provided adjacent to said first plurality of adjacent columns such that said first plurality of adjacent columns is provided in between said second plurality of adjacent columns and said first side of said ink jet head.

7. The ink jet printer according to claim 6, wherein said first-wavelength LED elements have a shorter wavelength than a wavelength of said second-wavelength LED elements.

8. The ink jet printer according to claim 6, wherein:

said moving means moves said ink jet head in a main scanning direction which is a feeding direction of said sheet, and in a secondary scanning direction which intersects with said feeding direction of the sheet at right angles; and wherein said first-wavelength LED elements and said second-wavelength LED elements are provided in the secondary scanning direction with respect to the ink jet head.

9. The ink jet printer according to claim 8, wherein said first-wavelength LED elements have a shorter wavelength than a wavelength of said second-wavelength LED elements.

10. The ink jet printer according to claim 6, wherein said first-wavelength LED elements are further arranged in a third plurality of adjacent columns that are provided adjacent to a second side of said ink jet head opposite to said first side, and wherein said second-wavelength LED elements are further arranged in a fourth plurality of adjacent columns that are provided adjacent to said third plurality of adjacent columns such that said third plurality of adjacent columns is provided in between said fourth plurality of adjacent columns and said second side of said ink jet head.

11. The ink jet printer according to claim 10, wherein said first-wavelength LED elements have a shorter wavelength than a wavelength of said second-wavelength LED elements.

12. The ink jet printer according to claim 10, wherein:

said moving means moves said ink jet head in a main scanning direction which is a feeding direction of said sheet, and in secondary scanning directions which intersects with said feeding direction of the sheet at right angles; and wherein said first-wavelength LED elements and said second-wavelength LED elements are provided in the secondary scanning directions with respect to the ink jet head.

13. The ink jet printer according to claim 12, wherein said first-wavelength LED elements have a shorter wavelength than a wavelength of said second-wavelength LED elements.

14. An ink jet printer forming an image using ultraviolet curing ink, comprising:

an ink jet head configured to eject out the ultraviolet curing ink onto a predetermined sheet;

moving means for moving said ink jet head relatively to said sheet; and a plurality of light emitting diode (LED) elements arranged in adjacent columns and rows, the LED elements including a plurality of first-wavelength LED elements and a plurality of second-wavelength LED elements, wherein said first-wavelength LED elements being arranged in a first column, and wherein said second-wavelength LED elements being arranged in a second column adjacent to said first column, and wherein said second column is arranged along the main scanning direction of said ink jet head.

* * * * *